United States Patent [19]

Farfaglia, deceased et al.

[11] Patent Number: 5,065,597

[45] Date of Patent: Nov. 19, 1991

[54] DUAL SIDE DISCHARGE AIR HOUSING FOR ROOM AIR CONDITIONER

[75] Inventors: Leonard T. Farfaglia, deceased, late of Brentwood, by Mary M. Farfaglia, legal representative; Timothy J. Campbell, Nashville; Billy P. Gipson, Marshall County; Thompson Matambo, Brentwood; Christoper M. Thompson, Smyrna, all of Tenn.

[73] Assignee: Whirlpool Corporation, Benton Harbor, Mich.

[21] Appl. No.: 522,172

[22] Filed: May 11, 1990

[51] Int. Cl.[5] ..... F25D 23/12

[52] U.S. Cl. ..... 62/262; 62/426; 62/407; 98/94.2

[58] Field of Search ..... 62/262, 426, 407, 412, 62/419; 98/94.2

[56] References Cited

U.S. PATENT DOCUMENTS

| | | | |
|---|---|---|---|
| 2,373,496 | 4/1945 | Paiste, Jr. . | |
| 2,373,497 | 4/1945 | Paiste, Jr. . | |
| 2,604,763 | 7/1952 | Lipman . | |
| 2,737,788 | 3/1956 | Buttner . | |
| 2,763,139 | 9/1956 | Callan et al. . | |
| 2,782,612 | 2/1957 | Spiegelhalter . | |
| 2,801,582 | 8/1957 | Kuhlenschmidt et al. . | |
| 2,885,142 | 5/1959 | Eberhart . | |
| 2,887,856 | 5/1959 | Wile et al. . | |
| 2,909,043 | 10/1959 | Baker et al. . | |
| 2,952,997 | 9/1960 | Mullin . | |
| 2,989,855 | 6/1961 | Thompson . | |
| 3,128,689 | 4/1964 | Binsfeld . | |
| 3,158,005 | 11/1964 | Jungemann . | |
| 3,159,983 | 12/1964 | Metcalfe . | |
| 3,221,512 | 12/1965 | Bakos . | |
| 3,274,919 | 9/1966 | Wegman . | |
| 3,301,166 | 1/1967 | Schwartz | 62/262 |
| 3,306,182 | 2/1967 | Schwartz . | |
| 3,320,871 | 5/1967 | Wegman . | |
| 3,472,149 | 10/1969 | Harrison . | |
| 3,477,211 | 11/1969 | Pietsch | 62/262 |
| 3,500,738 | 3/1970 | Wenig . | |
| 3,509,613 | 5/1970 | Koenig . | |
| 3,685,427 | 8/1972 | Loyd . | |
| 3,713,376 | 1/1973 | Ring . | |
| 3,756,039 | 9/1973 | Riello . | |
| 3,783,637 | 1/1974 | Woods . | |
| 3,805,542 | 4/1974 | Hosoda et al. | 62/262 |
| 3,938,348 | 2/1976 | Ricket . | |
| 4,100,764 | 7/1978 | Murano . | |
| 4,240,264 | 12/1980 | Nakada et al. . | |
| 4,492,094 | 1/1985 | Katayama . | |
| 4,633,770 | 1/1987 | Taylor et al. . | |
| 4,729,293 | 3/1988 | Tsunoda et al. . | |
| 4,777,870 | 10/1988 | Bolton et al. . | |

*Primary Examiner*—Albert J. Makay
*Assistant Examiner*—John Sollecito
*Attorney, Agent, or Firm*—Hill, Van Santen, Steadman & Simpson

[57] ABSTRACT

A room air conditioner in which separate lateral air outlets are provided for returning chilled air to the room. A blower wheel is used to draw air into the air conditioner through the evaporator and a housing for the blower wheel has two volute openings that lead to separate connecting passages to the outlet openings. An easily removable filter is provided at the front panel of the air conditioner which does not require removal of the front panel for its removal. Also a highly effective exhaust air door is provided in at least one of the connecting passages for use in exhausting air from the room.

20 Claims, 3 Drawing Sheets

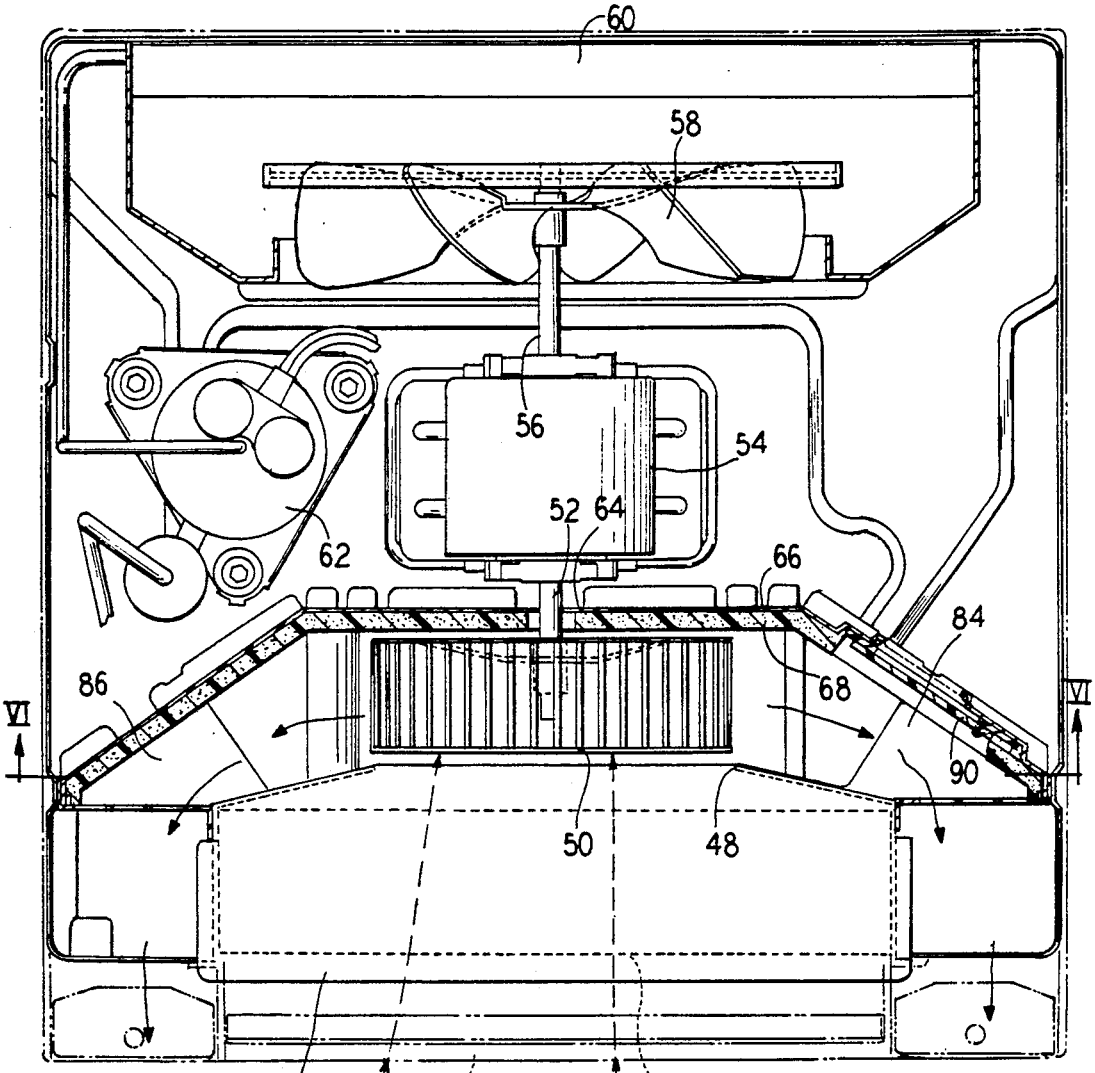
FIG. 3
FIG. 4
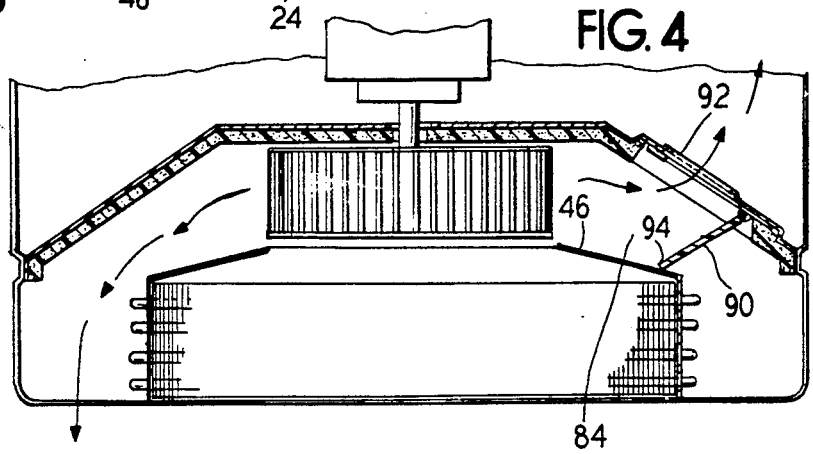

DUAL SIDE DISCHARGE AIR HOUSING FOR ROOM AIR CONDITIONER

BACKGROUND OF THE INVENTION

The invention is directed to a room air conditioner and more particularly to a room air conditioner having a dual air flow.

Room air conditioners generally have an air inlet and an air outlet at a front side of the air conditioner which faces the interior of the room when the air conditioner is positioned in a window opening or in a through the wall sleeve. Usually warm air is drawn in through a central portion of the front panel to pass through a filter and through the evaporator coil to be cooled and then is directed by a blower or fan to an outlet or outlets, also in the front panel. The outlet may be a single opening positioned either along a top or bottom edge of the front panel or may be a single opening positioned at one side or the other of the front panel. Occasionally the air from the blower is directed into a manifold type box or plenum chamber and from that chamber it is allowed to exit through the front of the air conditioner through more than one opening. For example in U.S. Pat. No. 3,472,149, assigned to the assignee of the present invention, air is drawn into the air conditioner unit through a lower front grill portion and is redelivered to the room through a grill portion which extends along the top edge of the air conditioner.

In U.S. Pat. No. 2,737,788, air is drawn in from a front lower grill opening, through a filter and the air is pressurized by a fan mounted in a manifold chamber or plenum from which air is permitted to exit through two spaced grills. In U.S. Pat. No. 4,492,094 air is drawn in through a front grill, is pressurized by a fan and exits through a grill 30 located at a bottom edge of the front panel. FIGS. 1 and 2 of that patent illustrate prior art constructions of top and side return of cooled air to the room.

The use of a manifold plenum chamber or similar structure requires an extra space in the air conditioner thereby reducing the compactness of the air conditioner and adding to bulkiness. Also such a structure requires extra parts and weight, thus increasing the cost and complexity of manufacturing. Oftentimes, particularly when the air outlet is positioned on a single side of the air conditioner, the air is drawn into the air conditioner evaporator coil in an off-center fashion thereby reducing the efficiency of the air conditioner.

The air filters generally are mounted behind the front cover and require removal of at least the front cover, and sometimes other structure, in order to access, remove, clean, and replace the filter, thus discouraging checking and cleaning of the filters. A dirty filter, of course, results in less efficient operation of the air conditioner.

The air filter shown in U.S. Pat. No. 2,737,788 does not appear to be viewable or accessible from the exterior of the air conditioner. Similarly, an air filter is disclosed in U.S. Pat. No. 3,274,919 which is not accessible without removal or displacement of parts of the air conditioner. U.S. Pat. No. 2,763,139 provides a filter element carried on a roll. The filter element is to be unrolled occasionally to provide a fresh filter portion in the inlet air flow path and the used portion is to be severed and discarded. To replace the roll it is necessary to remove the cover of the air conditioner.

While air exhaust doors are known for use with room air conditioners, permitting the air conditioner to be used to exhaust air from the room, such features ar usually relatively ineffective in that the exhaust door openings are quite small and are generally not positioned in the direct air flow path of the air leaving the evaporator fan. In U.S. Pat. No. 2,737,788 an exhaust door is provided in a side wall of the plenum chamber well away from the direct air flow path. In U.S. Pat. No. 3,783,637 an exhaust door is provided in a wall which is parallel to the air flow path in an upper air outlet chamber.

SUMMARY OF THE INVENTION

It is therefore an object of the present invention to provide an air conditioner that has a dual air flow exit without requiring the use of a manifold style plenum chamber or other similar space consuming structure in the interior of the air conditioner.

It is a further object to provide a room air conditioner that uses a single blower wheel to recirculate room air and yet provide a dual return path in a compact format.

It is a further object of the invention to provide a room air conditioner that has a dual air flow exit from the front lateral sides of the air conditioner in which the air flow from the two exits is substantially equal.

It is a further object of the invention to provide a room air conditioner that draws the air centrally through the evaporator to increase the efficiency of the room air conditioner.

It is a further object of the invention to provide a room air conditioner that has a readily accessible and removable air filter to promote removal of the filter element for checking an cleaning.

It is a further object of the invention to provide a room air conditioner that has the capability of acting as an effective exhaust blower in the event the user desires to use the air conditioner fan to exhaust air from the room.

These and other objects are accomplished by providing a room air conditioner that has a centrally located evaporator coil and directly behind the evaporator coil is a blower wheel which is configured and arranged to draw air in through the center of the wheel and cause the air to exit radially and tangentially as the wheel rotates. The wheel is located in a housing forming a volute with two separate openings that are configured and arranged so that approximately 50% of the air is caused to exit from each of the openings. The volute openings each communicate with a separate transition duct space which leads directly to the front panel of the air conditioner. Separate opening controls are provided at each front panel opening so that the user can select the desired flow path for the exiting air.

A filter is mounted in the front panel of the air conditioner and is readily removable from the front of the air conditioner without removal of the front panel. The filter media, an open cell foam material or other suitable material, is permanently formed on a filter support to enhance removability and cleanability of the filter element.

One or more exhaust doors are provided which may be selectively opened by the user to direct air leaving the volute openings to exit through the condenser coil or cabinet louvers, which are located in the rear of the air conditioner, when the user desires to use the air conditioner blower as a room air exhaust fan. The exhaust doors are positioned directly in the flow path of the air exiting the blower volute openings and thus direct a large volume of air towards the condenser coil or cabinet louvers, particularly in comparison with presently available room air conditioners.

BRIEF DESCRIPTION OF THE DRAWINGS

FIG. 3 is a top sectional view of the air conditioner of FIG. 1.

FIG. 4 is a partial top sectional view of the air conditioner of FIG. 1 illustrating the exhaust door in an open position.

DETAILED DESCRIPTION OF THE PREFERRED EMBODIMENT

Figure 1:
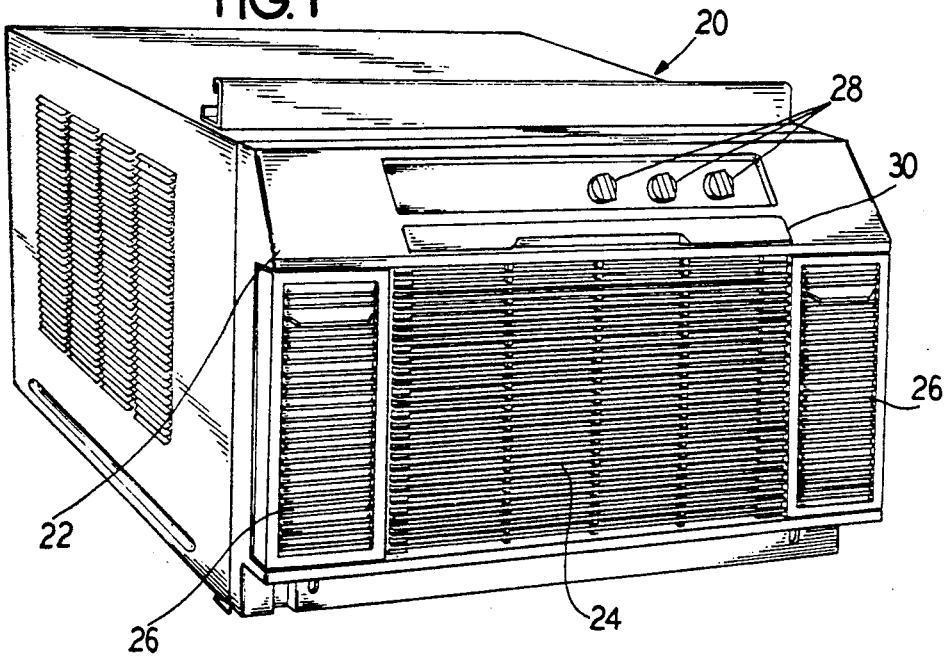
FIG. 1 is a perspective view of a room air conditioner embodying the principles of the present invention.

FIG. 1 illustrates an air conditioner generally at 20 which embodies the principles of the present invention. The air conditioner has a front panel 22 which faces the interior of a room to be cooled when the air conditioner unit is placed in an open window or in a through the wall sleeve. A central portion 24 of the panel constitutes an air inlet grill through which air flows into a portion of the air conditioning unit. The air is returned to the room through a pair of laterally spaced outlet grills 26. A particular preferred outlet grill construction is described in greater detail in copending application Ser. No. 522,198 entitled "Adjustable Louvers Assembly for a Room Air Conditioner" which disclosure is incorporated herein by reference. The outlet grills 26 are independently controllable by the user and contain louvers that are pivotable about both a vertical and horizontal axis giving the user a wide range of air flow configurations.

Figure 2:
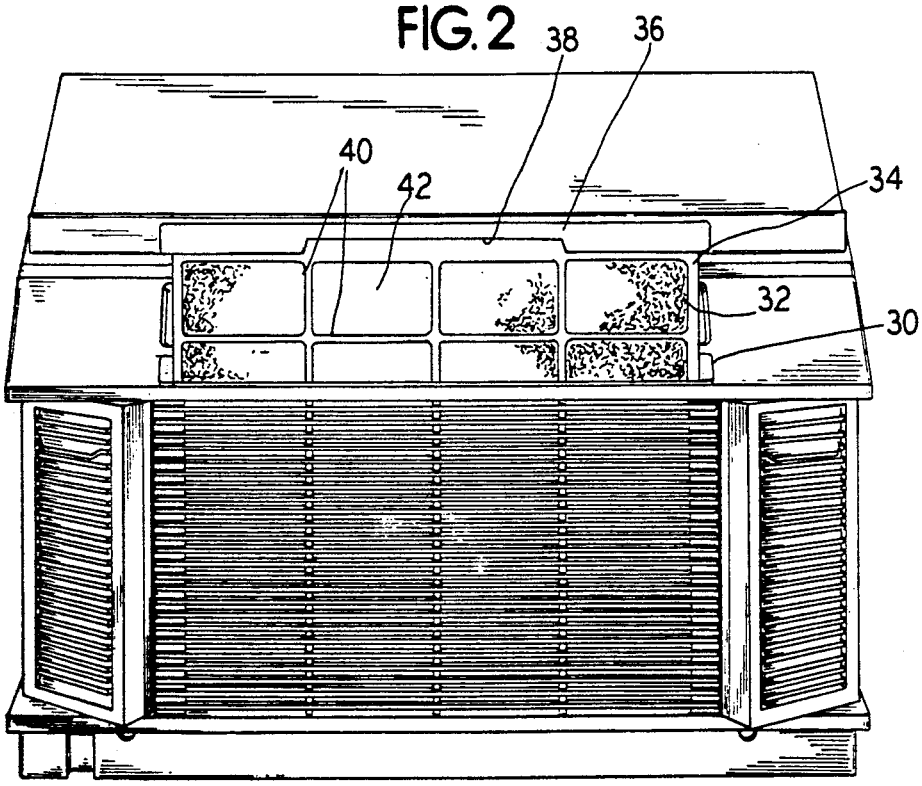
FIG. 2 is a front/top perspective view of the air conditioner of FIG. 1 illustrating removability of the filter element.

A plurality of controls 28 are provided on a control panel area above the inlet grill. Positioned above the inlet grill 24 and below the controls is a slot 30 within which is received an air filter element 32, shown in a partially inserted position in FIG. 2. The air filter 32 is comprised of a semi-rigid frame 34 including a top bar 36 having a recessed finger grip are 38 and a plurality of rectangular framing elements 40 forming a plurality of open areas 42 within which is permanently mounted a filter media such as an open cell foam. The placement of the filter 32 causes the filter element to be readily accessible from the exterior of the air conditioner cabinet and does not require removal of any portions of the air conditioner cabinet in order for the filter to be removed to determine whether it needs to be cleaned. Replacement of the filter element is just as easy, that is by sliding the filter frame 34 into the slot 30.

The internal components of the air conditioner are shown in greater detail in FIG. 3 and in this view the symmetrical nature of the air conditioner construction and symmetrical nature of the air flow is quite evident. Directly behind the front inlet grill 24 is located the evaporator 44 which is mounted within a sheet metal housing 46. The housing 46 has a central rear opening 48 which is positioned directly in front of an air moving device, preferably a blower wheel 50. The blower wheel 50 is mounted on a forwardly extending drive shaft 52 of an electric motor 54. The motor 54 also has a rearwardly extending drive shaft 56 to which a fan blade 58 is mounted. The drive shafts 52, 56 extend along the center line of the air conditioner. Directly behind the fan blade is the condenser coil 60. A compressor 62 is provided as is known in the art.

The forwardly extending drive shaft 52 extends through a opening 64 in a barrier wall 66 provided between the blower wheel 50 and the motor 52. The barrier wall 66 separates the cold side of the air conditioner (forward of the wall) from the hot side (rearward of the wall). This is desireable to prevent air which has been chilled by passing through the evaporator 44 from being inadvertently discharged through the rear of the air conditioner and to prevent hot air in the condenser portion of the air conditioner from being inadvertently drawn into the cold portion of the air conditioner. A barrier of expanded polystyrene 68 is provided along the barrier wall 66 which provides an insulation against heat transfer. A preferred assembly method and construction of the air conditioner is described in greater detail in copending application Ser. No. 522,180 entitled "Assembly Method and Construction for a Room Air Conditioner" which disclosure is incorporated herein by reference.

Figure 6:
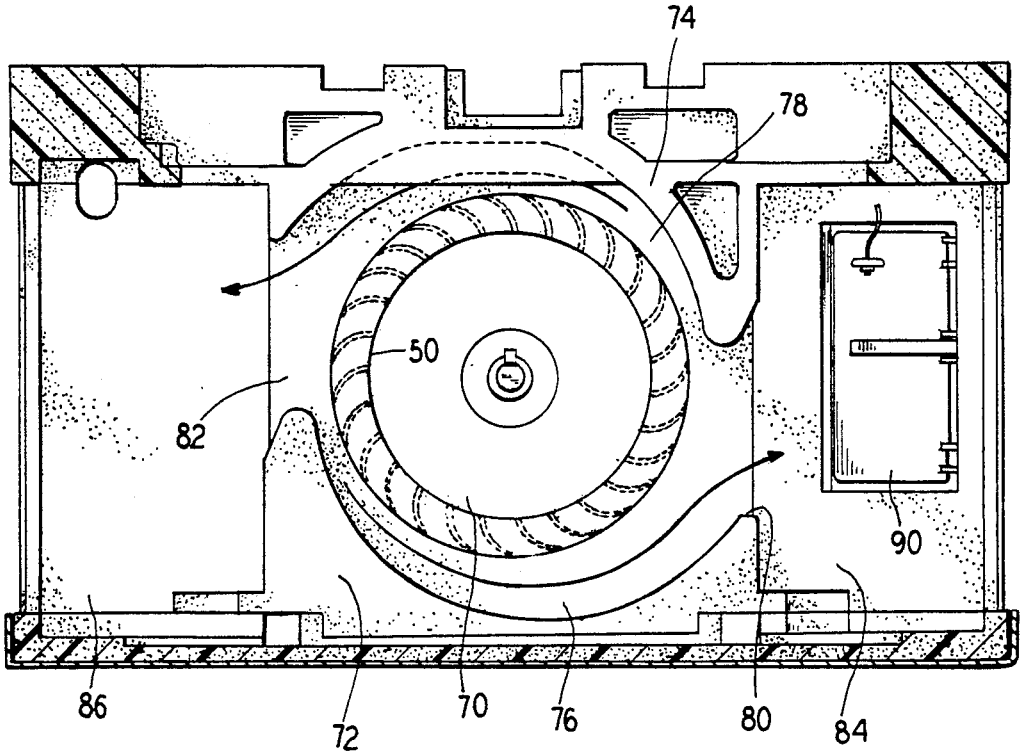
FIG. 6 is a front sectional view of the air conditioner taken generally along the line IV—IV of FIG. 3.

As best shown in FIG. 3 and FIG. 6, as the blower wheel 50 rotates, air is symmetrically drawn into the open center area 70 of the blower wheel 50 from through the opening 48 in the evaporator housing and is caused to leave the blower wheel with radial and tangential flow components. The central location of the opening 48 assures even flow of air through the evaporator coil which enhances the efficiency of heat transfer at the evaporator coil. The expanded polystyrene wall 68 includes forward projecting portions 72, 74 surrounding the blower wheel which form a pair of volute passages 76, 78 and which lead respectively to right and left lateral openings 80, 82. The volute passages 76, 78 and openings 80, 82 are configured and arranged so as to approximately evenly divide the air stream generated by the fan blower 50 and to direct each separate air stream exit through a separate opening. The expanded polystyrene wall is shown and described in greater detail in copending application Ser. No. 522,179 entitled "Dual Side Discharge Room Air Conditioner with Foamed Insulation Air Passage Walls" which disclosure is incorporated herein by reference.

Adjacent and downstream of each opening 80, 82 is a transition air duct 84, 86 which is formed by a portion of the barrier wall 66 which is angled forwardly so as to redirect the air from the blower toward the front of the air conditioner. The opposite side of each of the transition air ducts is formed by a rear angled wall of the evaporator housing 46. The control of the air flow leaving the air conditioner is described in greater detail in copending application Ser. No. 522,199 entitled "Dual Louvered Side Air Discharge Openings For Room Air Conditioner" which disclosure is incorporated herein by reference.

As shown in FIGS. 3 and 4, an exhaust door 90 may be provided to cover an opening 92 in the portion of the barrier wall 66 which forms the transition duct 84. The position of the exhaust door may be controlled by one of the control knobs 28 on the front of the air conditioner. As shown in FIGS. 4 and 6, when it is desired to exhaust air from the room (usually with the compressor 62 turned off and in a non-cooling mode of the air conditioner), the exhaust door 90 may be partially or fully opened. When door 90 is fully open the exhaust door blocks virtually the entire width of the transition duct 84 in that a free end 94 of the door 90 abuts against the evaporator housing 46. The door 90 has a relatively large height in comparison with the transition duct 84 and is positioned so as to be directly in the flow path of air exiting from the blower wheel 50. Thus, due to the size, configuration and placement of the door 90, a large portion of the air exiting through opening 80 may be caused to flow through the exhaust opening 92 into the rear portion of the air conditioner. The size, configuration and placement of the exhaust door can provide a 500% increase in exhaust air flow over air conditioner models presently provided by the assignee of the present invention. That is, instead of a 5–10 cfm air exhaust capability, the present arrangement provides approximately 30–50 cfm air exhaust movement.

Figure 5:
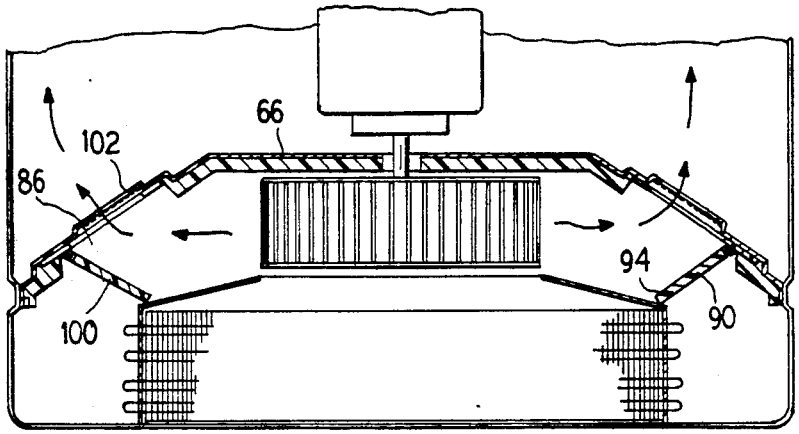
FIG. 5 is a partial top sectional view of an alternate embodiment illustrating use of two exhaust doors.

As shown in FIG. 5, an alternative embodiment of the present invention is illustrated in which a second exhaust door 100 is provided to selectively close an exhaust opening 102 in the portion of the barrier wall 66 which forms a portion of transition duct 86. If both such doors are utilized, their size, configuration and placement would result in most of the air moved by the blower 50 to be exhausted from the air conditioner.

Thus, it is seen that the present invention provides an air conditioner that has a dual air flow exit without requiring the use of a manifold style plenum chamber or the other similar space consuming structure in the interior of the air conditioner. By using a single blower wheel to recirculate room air which is carried within a housing forming two volute passages with separate exits, the invention provides a dual return path in compact format. By centrally locating the blower, air is drawn through the evaporator centrally and symmetrically to increase the efficiency of the air conditioner. A readily accessible and removable air filter is provided on the front panel and the use of a large, well positioned air exhaust door allows the air conditioner to act as an effective exhaust blower.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A room air conditioner comprising:

an evaporator coil centered on a center line of and at a front side of said air conditioner;

an air moving device centered behind said evaporator coil for causing air to flow in a stream evenly through said evaporator coil;

a housing for said air moving device centered behind said evaporator coil having a pair of openings positioned on opposite sides of said air moving device for dividing said air stream into two separate and substantially equal air streams; and two separate air conduits being substantially equal in size and shape and being positioned symmetrically relative to said center line for directing said separate air streams toward two separate air exit openings at a front side of said air conditioner, said air exit openings being substantially equal in size and shape, said openings, air conduits and air exit openings defining means for evenly drawing air into said air conditioner, split into two relatively equal streams and directed out of said air conditioner in two streams of substantially equal air flow.

2. A room air conditioner according to claim 1, wherein said air moving device comprises a blower wheel mounted on a horizontal axis.

3. A room air conditioner according to claim 2, wherein said housing comprises a pair of volute passages enclosing said blower wheel.

4. A room air conditioner according to claim 2, wherein said pair of openings in said housing are arranged at opposite lateral sides of said blower wheel.

5. A room air conditioner according to claim 1, wherein said separate air streams are directed by said air moving device in a exit direction other than forward and said air conduits have angled walls to redirect said divided air flow from an exit direction to a forward direction.

6. A room air conditioner according to claim 5, wherein at least one exhaust opening, selectively closed by a movable door is positioned in at least one of said angled walls.

7. A room air conditioner according to claim 1, wherein said front side of said air conditioner comprises an air inlet grill and a removable filter element is mounted between said air inlet grill and said evaporator and is removable from said air conditioner without removal of said grill.

8. A room air conditioner according to claim 6 wherein said door, when fully open, blocks virtually an entire width of said air conduit, and said door has a relatively large height in comparison with said air conduit.

9. A room air conditioner comprising:

an evaporator coil centered on a center line of and located at a front side of said air conditioner;

a condenser soil located at a rear side of said air conditioner;

a barrier wall separating said evaporator coil from said condenser coil;

an air moving device centered behind said evaporator coil located in a housing directly behind said evaporator coil and in front of said barrier wall, said air moving device being arranged so as to draw air in a stream from in front of said air conditioner through said evaporator coil and into said air moving device; and a pair of openings positioned on opposite sides of said air moving device in said housing for dividing the air stream into two separate and substantially equal air streams after it has passed through said air moving device and two separate connecting air conduits being substantially equal in size and shape and being positioned symmetrically relative to said center line for directing said separate air streams toward two separate air exit openings at said front side of said air conditioner, said air exit openings being substantially equal in size and shape, said openings, air conduits and air exit openings defining means for evenly drawing air into said air conditioner, split into two relatively equal streams and directed out of said air conditioner in two streams of substantially equal air flow.

10. A room air conditioner according to claim 9, wherein said housing has a rear wall which abuts against said barrier wall.

11. A room air conditioner according to claim 9, wherein said air moving device comprises a blower wheel mounted on a horizontal axis.

12. A room air conditioner according to claim 11, wherein said housing comprises a pair of volute passages enclosing said blower wheel.

13. A room air conditioner according to claim 11, wherein said pair of openings in said housing are arranged at opposite lateral sides of said blower wheel.

14. A room air conditioner according to claim 9, wherein said separate air streams are directed by said air moving device in an exit direction other than forward and said connecting air conduits have angled walls to redirect said split air flow from an exit direction to a forward direction.

15. A room air conditioner according to claim 14, wherein at least one exhaust opening, each selectively closed by a movable door, is positioned in at least one of said angled walls.

16. A room air conditioner according to claim 15, wherein two exhaust openings are provided, one in each of said connecting air conduits.

17. A room air conditioner according to claim 9, wherein said air moving device is mounted and arranged to draw air centrally through said evaporator.

18. A room air conditioner according to claim 9, wherein said front side of said air conditioner comprises an air inlet grill and a removable filter element is mounted between said air inlet grill and said evaporator and is removable from said air conditioner without removal of said grill.

19. A room air conditioner according to claim 15, wherein said door, when fully open, blocks virtually an entire width of said air conduit, and said door has a relatively large height in comparison with said air conduit.

20. A room air conditioner comprising:

an evaporator coil centered on a center line of and located at a front side of said air conditioner;

a condenser coil located at a rear side of said air conditioner;

a barrier wall separating said evaporator coil from said condenser coil;

a rotatable blower wheel located in a housing comprising a pair of volute passages enclosing said blower wheel, said blower wheel being located directly behind said evaporator coil and in front of said barrier wall, said air moving device being arranged so as to draw air in a stream from in front of said air conditioner through said evaporator coil and into said air moving device;

a pair of openings in said housing arranged at opposite lateral sides of said blower wheel for dividing the air stream into two separate and substantially equal air streams after it has passed through said air moving device;

two separate connecting air conduits being substantially equal in size and shape and being positioned symmetrically relative to said center line for directing said separate air streams toward two separate air exit openings at laterally spaced positions on said front side of said air conditioner on opposite sides of said evaporator coil, said separate air streams being directed by said air moving device in an exit direction other than forward and said connecting air conduits having angled walls to redirect said split air flow from an exit direction to a forward direction;

at least one exhaust opening, each selectively closed by a movable door positioned in at least one of said angled walls said door, when fully open, blocking virtually an entire width of said connecting air conduit, and said door having a relatively large height in comparison with said connecting air conduit; and said front side of said air conditioner comprising an air inlet grill and a removable filter element being mounted between said air inlet grill and said evaporator and being removable from said air conditioner without removal of said grill, said openings, air conduits and air exit openings defining means for evenly drawing air into said air conditioner, splitting said air into two relatively equal streams and directing said air out of said air conditioner in two streams of substantially equal air flow.

* * * * *